US005992367A

United States Patent [19]

Santi et al.

[11] Patent Number: 5,992,367

[45] Date of Patent: Nov. 30, 1999

[54] COMPRESSION RELEASE FOR MULTI-CYLINDER ENGINES

[76] Inventors: John D. Santi, 2141 S. 70th St., West Allis, Wis. 53214; David A. Kratz, 4445 N. 150th St., Brookfield, Wis. 53005

[21] Appl. No.: 09/113,694

[22] Filed: Jul. 10, 1998

Related U.S. Application Data

[62] Division of application No. 08/853,339, May 8, 1997, Pat. No. 5,823,153.

[51] Int. Cl.[6] ..... F01L 13/08

[52] U.S. Cl. ..... 123/182.1

[58] Field of Search ..... 123/182.1

[56] References Cited

U.S. PATENT DOCUMENTS 3,511,219 5/1970 Esty ..... 123/182.1

FOREIGN PATENT DOCUMENTS 3-294610 12/1991 Japan ..... 123/182.1

*Primary Examiner*—Andrew M. Dolinar

*Attorney, Agent, or Firm*—Michael Best & Friedrich LLP

[57] ABSTRACT

The centrifugally-responsive compression release apparatus of the present invention is a compact unit which can be simply snap-fit to a position on the cam shaft during assembly and will retain that position during engine operation. The compression release apparatus relieves compression in at least one chamber of an internal combustion engine by utilizing a lift member engageable with a valve operating device and centrifugally-responsive means for changing the position of the lift member in response to engine speeds. The apparatus includes a base member which can be injection molded to a shape of a segmented cylinder thereby substantially corresponding to the shape of the outer surface of the cam shaft. The base member also provides means for integrating and retaining the dynamic components of the apparatus to the base member. Furthermore, the compression release apparatus is adaptable to utilizing a single centrifugally-responsive means, such as a flyweight, to engage more than one valve operating device, thereby relieving pressure in more than one combustion chamber. Thus, the compression release apparatus is easy to manufacture and easy to install on the engine, and does not require any major modification to engine components.

29 Claims, 8 Drawing Sheets

FIG. 1
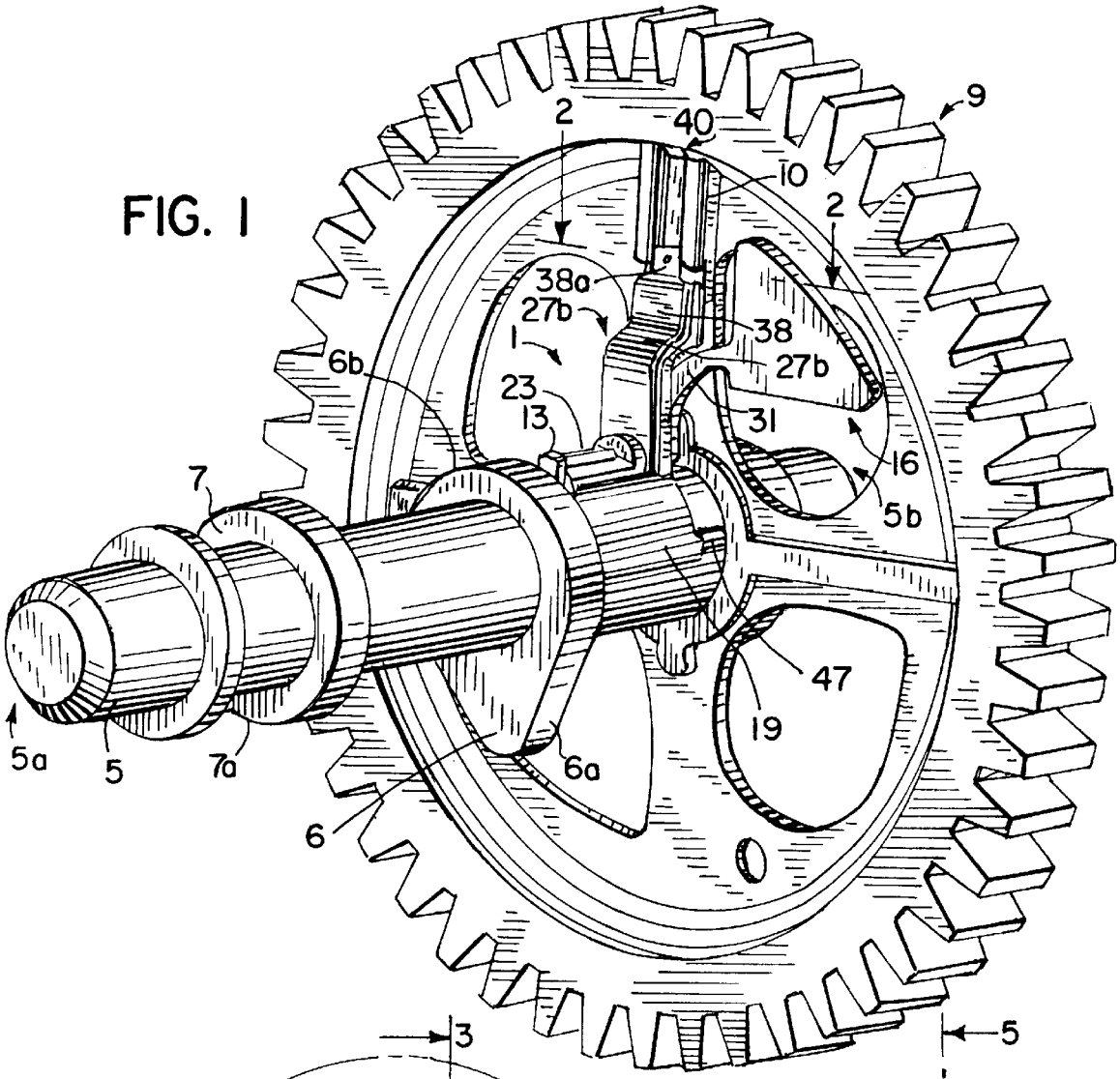
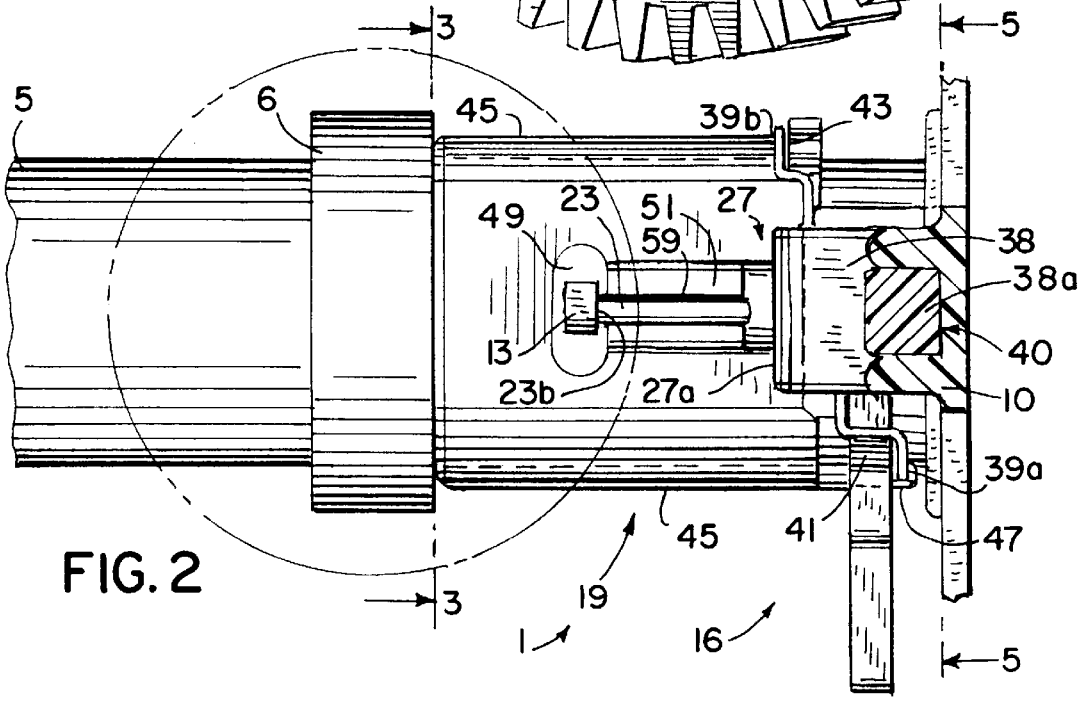
FIG. 2

FIG. 8
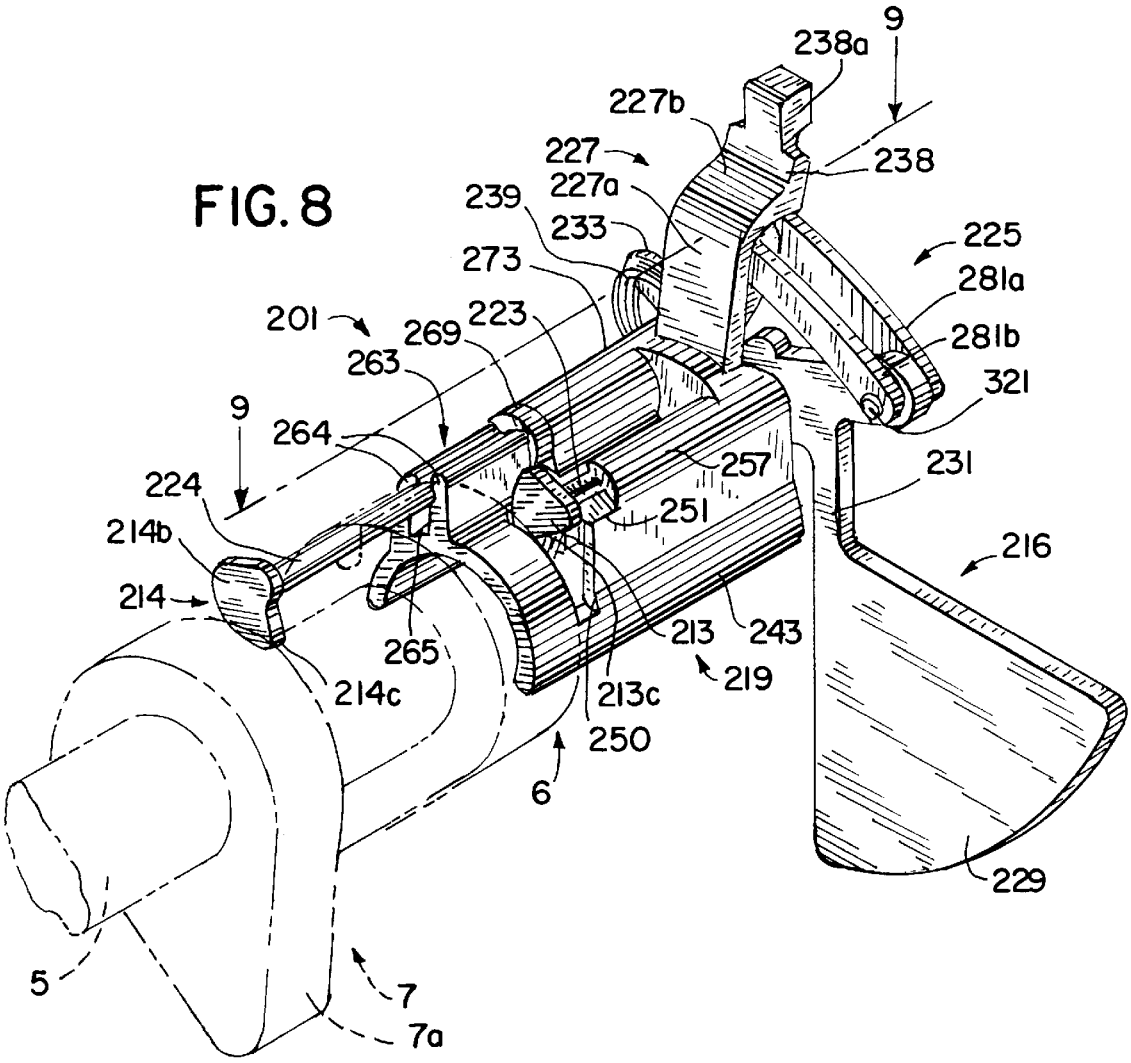
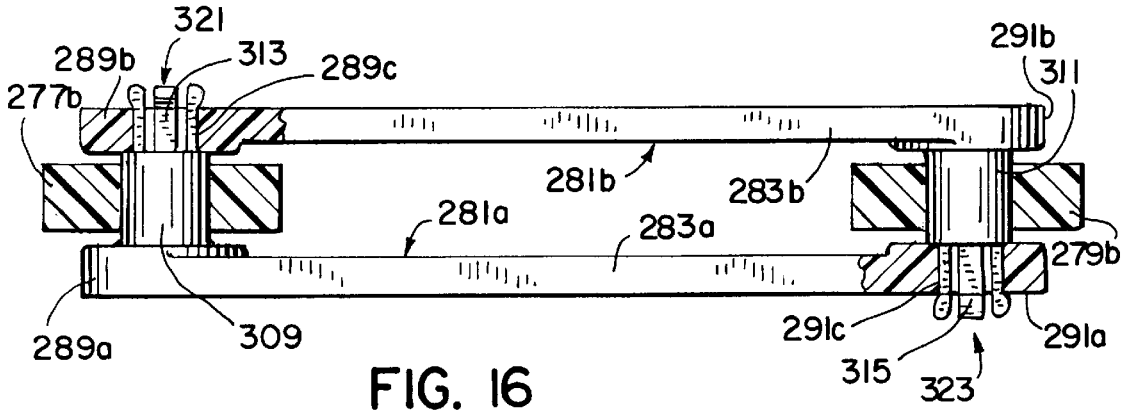
FIG. 16

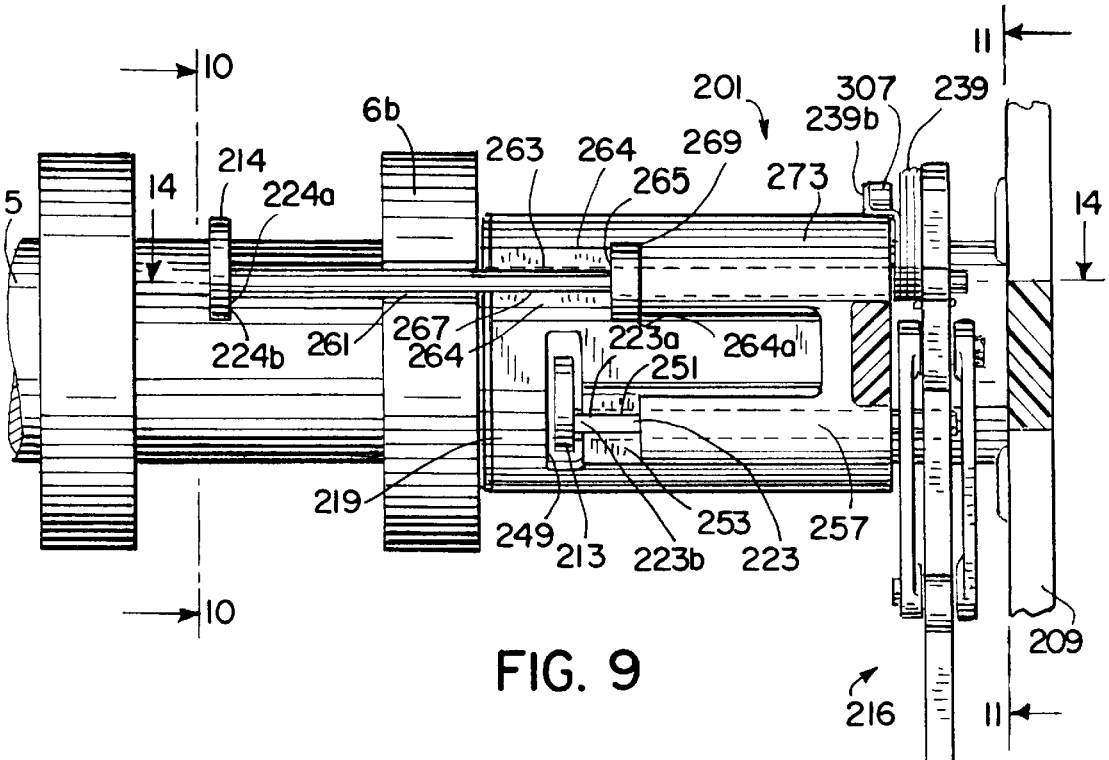
FIG. 9
FIG. 15
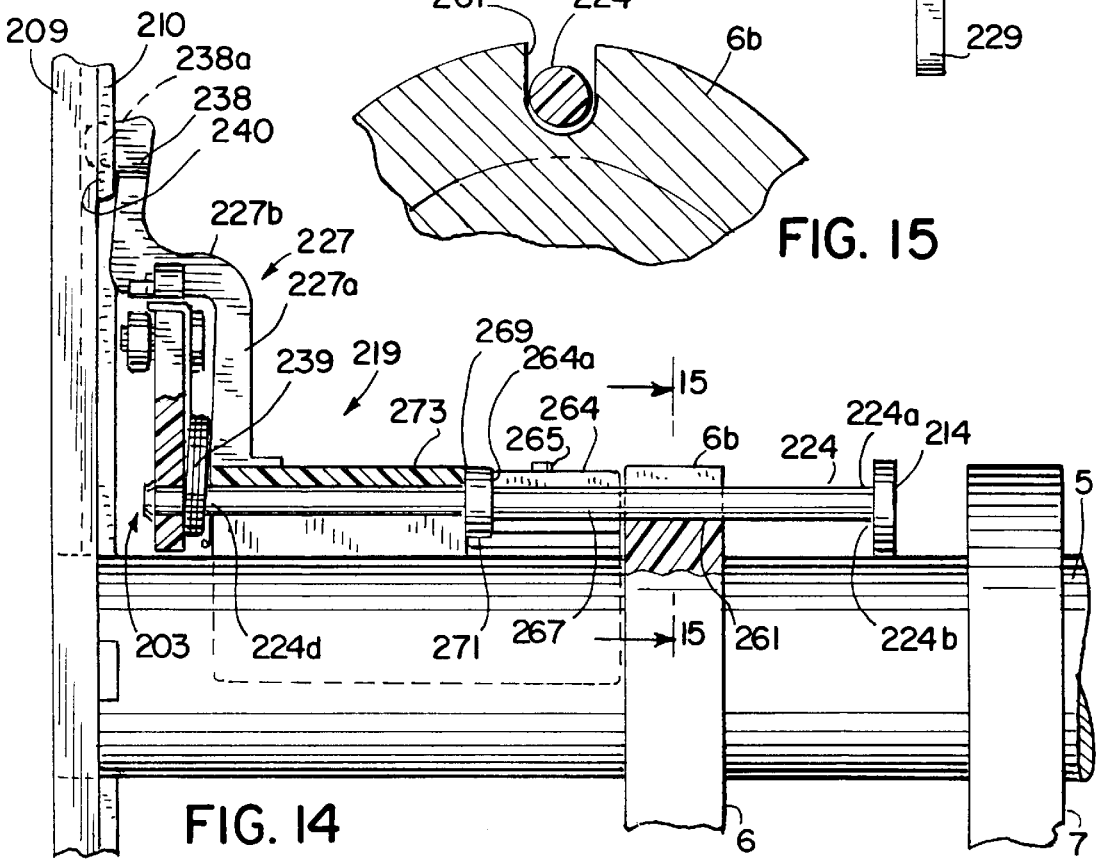
FIG. 14

COMPRESSION RELEASE FOR MULTI-CYLINDER ENGINES

This application is a divisional application of Ser. No. 08/853,339 filed May 8, 1997, now U.S. Pat. No. 5,823,153 issued Oct. 20, 1998.

BACKGROUND OF THE INVENTION

The present invention relates generally to internal combustion engines, and more particularly to a compression release mechanism which operates a valve at low engine speeds to relieve compression within one or more engine cylinders during the compression stroke of the engine cycle.

It is often desirable to relieve the compression in an engine combustion chamber during starting in order to reduce the force required to turn over the engine. By relieving this compression, it is much easier for the piston to reciprocate in the engine when the operator manually pulls the starter rope. Thus, a compression release mechanism lessens the pull force required to start the engine. As a result, the potential for operator fatigue during manual starting is also minimized.

Compression relief apparatus of the centrifugally-responsive type are disclosed in U.S. Pat. No. 3,381,676 issued May 7, 1968 to Campen, No. 4,453,507 issued Jun. 12, 1984 to Braun, et. al., No. 4,892,068 issued Jan. 9, 1990 to Coughlin, No. 4,898,133 issued Feb. 6, 1990 to Bader, No. 4,977,868 issued Dec. 18, 1990 to Holschuh, No. 5,184,586 issued Feb. 9, 1993 to Buchholz, and No. 5,197,422 issued Mar. 30, 1993 to Oleksy et. al. These patents reveal a variety of designs for centrifugally-responsive compression release mechanisms for internal combustion engines.

The Campen '676 compression release mechanism is typical of the prior art. Campen '676 includes a centrifugally-responsive flyweight, a torsion spring attached to the flyweight, and a central pin member therein which engages a valve tappet at engine starting speeds. At higher engine speeds, the flyweight moves radially outward so that the pin disengages the valve tappet when the engine is running.

A major disadvantage of many prior centrifugally-responsive compression release devices is that the design often requires a major modification to engine components or additional parts in order to attain the requisite stability and reliability. These modifications present an undesirable burden on the assembly process and on component manufacturing. As a result, the overall cost for the engine and for its maintenance is increased.

In the Campen apparatus, for example, the cam shaft must be modified prior to assembly to include the central pin member therein. Also, the shaft about which the flyweight rotates must be fastened to the flyweight, resulting in additional complexity and expense. In Coughlin '068, the flyweight must be attached to the timing gear by a rivet during assembly. In Holschuh '868, the cam lobes on the cam shaft must be machined for assembly of the compression release device.

The compression release apparatus in Buchholz '586 illustrates another problem. The Buchholz '586 compression release apparatus is disposed on the outboard side of the outboard cam lobe. Since the components of the compression release apparatus encircle the cam shaft, these components must be specially machined to accommodate the cam shaft prior to assembly. Furthermore, the apparatus must be installed on the cam shaft in conjunction with the assembly of the other engine components that are mounted on the cam shaft.

The problems of prior art compression release mechanisms are further magnified when it is desired to relieve compression in more than one combustion chamber of an engine. Foremost, the foregoing designs are not readily adaptable to operating a plurality of valves, such as the exhaust valves of a V-twin engine. To incorporate the prior art designs on such an engine would require a duplication of parts, and a significant increase in weight and complexity.

In general, the centrifugally-responsive compression release mechanisms of the prior art are either too complex, employ too many parts, or require a major modification to the engine. Moreover, many of these devices place too great a burden on assembly and manufacturing, thereby increasing cost further.

SUMMARY OF THE INVENTION

An improved centrifugally-responsive compression release mechanism is disclosed that is lightweight and simple in design and construction, but is sturdy and reliable. It does not require a major modification of the engine for installation. In fact, the compression release apparatus of the present invention has a design which facilitates engine assembly and component manufacturing. As a result, the compression release mechanism of the present invention is less expensive to incorporate into an internal combustion engine than prior art compression release mechanisms. Moreover, the compression release mechanism of the present invention is adaptable to engaging more than one valve operating device or to relieving compression in more than one combustion chamber of an engine, without substantially duplicating parts, assembly time and costs.

Specifically, the centrifugally-responsive compression release apparatus of the present invention can be simply snap-fit to a position on the cam shaft and/or cam gear during assembly, and will retain that position during engine operation. The apparatus may even be installed after most other components contained within the engine housing are installed. Furthermore, most of the components of the apparatus may be injection molded from a plastic material to reduce the weight of the unit and to facilitate manufacturing. As shown in a second embodiment of the invention, the compression release apparatus of the present invention may use a single centrifugally-responsive means to engage more than one valve operating device, thereby relieving compression in more than one combustion chamber.

In its broadest form, a compression release apparatus according to the present invention relieves compression in at least one combustion chamber of an engine by utilizing at least one lift member positioned substantially outside of the cam shaft and engageable with a valve operating device, and centrifugally-responsive means for changing the position of the lift member in response to engine speeds. In one embodiment, the apparatus includes a base member having a shape which allows the compression release mechanism to be snap-fit to a position adjacent the cam shaft during engine assembly and which acts to maintain the apparatus' position during engine operation. The base member also provides means for retaining and integrating the dynamic components of the apparatus, including the lift member and centrifugally-responsive means, to the base member. Furthermore, the plastic base member is injection molded to a shape of a segmented cylinder, thereby substantially corresponding to the shape of the outer surface of the cam shaft. Thus, the compression release apparatus is easy to manufacture and easy to assemble on the engine, without requiring any major modification to the cam shaft or cam gear.

In several embodiments of the invention, an arm is provided which is interconnected with the base member and which assists the base member in maintaining the position of the compression release apparatus on the cam shaft. In one embodiment, the arm extends from the top of the base member and abuts a shoulder on the cam gear.

In several embodiments, the centrifugally-responsive means is a flyweight. The flyweight and the lift member are interconnected via a rotatable lift pin, the lift member being connected to the lift pin on an outboard end and the flyweight being connected to the lift pin on an inboard end. In operation, the flyweight rotates about the axis of the lift pin.

The apparatus may also be provided with means for returning the flyweight to its rest position upon a sufficient reduction in engine speed. In one embodiment, the returning function is provided by a torsion spring engaged with the flyweight and biased against its movement. At slower engine speeds, the spring force is sufficient to return the flyweight to a rest position.

When the flyweight is at, or near, its rest position, the lift member engages the valve operating device causing it to partially unseat an associated exhaust valve of a combustion chamber during the compression stroke. Since the flyweight remains at, or near, its rest position when the engine is started, partial unseating of the exhaust valve effectively reduces compression in the chamber. When the engine attains a predetermined running speed, the flyweight is moved radially outward by sufficient centrifugal force to overcome the spring force and/or gravitational force resisting the movement of the flyweight. Accordingly, the interconnected lift member rotates as well, so that the cam lobe engages the valve operating device throughout the engine cycle. Thereafter, the valve operating device completely seats the exhaust valve during the compression stroke and allows compression in the combustion chamber in accordance with the normal engine cycle. When the engine speed is reduced below a predetermined speed, as when the engine is stopped, the flyweight returns to its rest position. Upon subsequent starting of the engine, the lift member is again engageable with the valve operating device and the exhaust valve is partially unseated during the compression stroke.

The base member of the present invention is also specially designed to accommodate and retain the various dynamic components of the apparatus. In one embodiment, the base member provides a roller pocket in which the lift member is allowed to rotate. It also provides a channel and groove to guide the rotation of the lift pin and to support lift pin loads. Furthermore, the base member has a projection onto which one end of the torsion spring is firmly attached. This attachment allows the spring to be biased against movement of the flyweight, such that movement of the flyweight causes the spring to compress against the attachment. Finally, a second projection that is adjacent to the cam shaft and extends from a lower portion of the base member, maintains the flyweight in an outward position during installation of the apparatus on the cam shaft.

In a second embodiment, the compression release apparatus of the present invention is adapted to engage more than one valve operating device while employing a single centrifugally-responsive means. In the second embodiment the apparatus engages two separate valve operating devices to relieve compression in two separate chambers of an internal combustion engine of the V-twin design. Each valve operating device operates an exhaust valve for one of the two combustion chambers. The compression release apparatus may also include means for interconnecting the single flyweight with the lift members. In one embodiment, the interconnecting means includes rotatable lift pins for transmitting radial movement of the flyweight to rotation of the lift members. Thus, the lift members are responsive to the rotation or the radial movement of the flyweight.

In the second embodiment, a base member and an arm member are provided for maintaining the apparatus in its position adjacent the cam shaft. The base member also includes means for accommodating and retaining the dynamic components of the apparatus, including separate guide and support means for the first and second lift pins.

As in the first embodiment, a flyweight is provided in the second embodiment which is centrifugally responsive to changes in engine speed. Radial movement of the flyweight changes the positions of the lift members. When the flyweight is extended radially outward, the lift member disengages from the valve operating device and the cam lobes interact with the valve operating devices to cause the exhaust valves to seat and unseat in accordance with the normal engine cycle. When the flyweight is at, or near, its rest position, the lift members engages the valve operating devices during the compression stroke to partially unseat the exhaust valves and to reduce the compression in the chambers. In alternative embodiments, the compression release apparatus may be designed to partially unseat the exhaust valves of a plurality of chambers simultaneously, sequentially or in some other manner as is required by engine operation.

In a further embodiment of the invention, the compression release apparatus provides means for interconnecting the pair of lift members to the flyweight and for causing the lift members to move in response to radial movement of the flyweight. The interconnecting means includes connecting arms connected to each of the two lift pins and a pair of links connecting the pair of connecting arms. Furthermore, the flyweight is connected to a first connecting arm. Thus, the first connecting arm is responsive to radial movement of the flyweight and the second connecting arm is responsive to movement of the first connecting arm.

In alternative embodiments, the compression release apparatus may utilize a variety of connecting arm-linkage arrangements to transmit energy from the radial movement of a centrifugally-responsive flyweight to movement of a valve operating device. In one embodiment, the flyweight is directly connected to one or both lift pins. In another embodiment, the flyweight is directly connected to one or both lift members. In yet another embodiment, the flyweight is disposed between two lift members or two lift pins. These specific embodiments, and further embodiments, of the invent-ion will be discussed in detail.

In another set of embodiments of the present invention, a centrifugally-responsive flyweight transfers motion to one or more lift pins or lift members through engagement of two or more gears. In these embodiments, a driving gear is integrated into an axial end of the flyweight. When the flyweight moves radially in response to engine speed, the driving gear drives one or more secondary gears disposed between one or more lift members and the flyweight. In one embodiment, the driving gear is a wheel type gear. In an alternative embodiment, the driving gear is a rack gear which transfers linear motion of the flyweight into rotation of one or more secondary gears. In both embodiments, the secondary gear is interconnected with a lift member such that rotation of the secondary gear results in movement of the lift member. When a lift pin is used, the secondary gear is mounted onto an inboard end of the lift pin such that rotation of the gear translates to rotation of the lift pin.

In an embodiment including two lift members, a driving gear is adapted to drive two secondary gears simultaneously. In another embodiment, a driving gear is adapted to drive a secondary gear that is interconnected with a first lift member, but the secondary gear is also adapted to drive a follower gear that is interconnected with a second lift member. In yet another embodiment, the driving gear is mounted onto an inboard end of a first lift pin and interconnected with a first lift member, but is also engaged to drive a secondary gear that is interconnected with a second lift member.

It is a feature and advantage of the present invention to provide a centrifugally responsive compression release apparatus which is relatively inexpensive to manufacture and easy to install on an engine.

It is another feature and advantage of the present invention to provide a centrifugally responsive compression release apparatus which does not require a major modification to the engine.

It is yet another feature and advantage of the present invention to provide a compression release apparatus which can be snap-fit onto the cam shaft during assembly.

It is yet another feature and advantage of the present invention to provide a compression release mechanism which is lightweight, but yet sturdy and reliable.

It is yet another feature and advantage of the present invention to provide a compression release apparatus which employs a single flyweight to change the position of more than one valve operating device in response to engine speed.

These and other features and advantages of the present invention will be apparent to those skilled in the art from the following detailed description of the preferred embodiment and from the attached drawings, in which:

BRIEF DESCRIPTION OF THE DRAWINGS

FIG. 1 is a perspective view of a compression release apparatus in accordance with the present invention.

FIG. 2 is a top view of the compression release apparatus of FIG. 1.

FIG. 8 is a perspective view of a second embodiment of the compression release apparatus, including two lift members, two lift pins and a single flyweight.

FIG. 9 is a top view of the second embodiment of the present invention, taken along 9—9 of FIG. 8.

FIG. 14 is a cross-sectional side view of the second embodiment of the present invention, taken along line 14—14 of FIG. 9.

FIG. 15 is a cross-sectional view of the second embodiment of the present invention depicting a groove in the cam lobe, taken along line 15—15 of FIG. 14.

FIG. 16 is a cross-sectional view of the double link arrangement and the primary and secondary connecting arms, taken along line 16—16 of FIG. 11.

DETAILED DESCRIPTION OF THE PREFERRED EMBODIMENT

Figure 4:
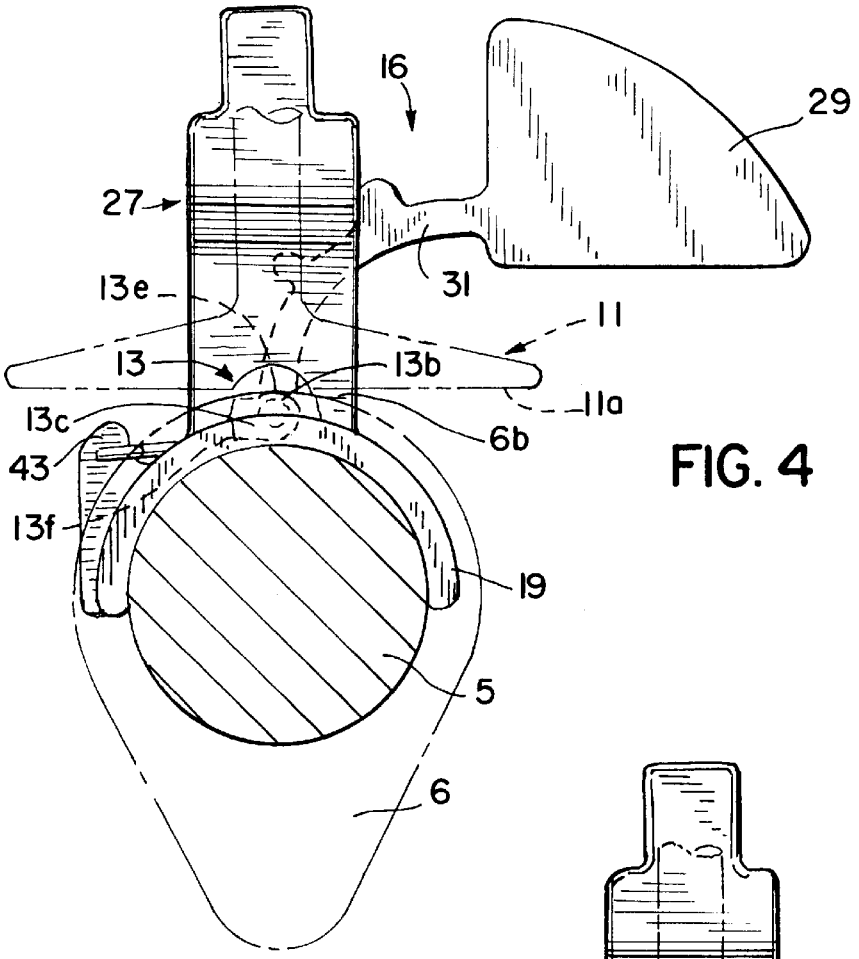
FIG. 4 is a cross-sectional end view of the compression release apparatus similar to the view of FIG. 3, with the flyweight in the radially-outward position.

FIGS. 1 through 7, FIGS. 8 through 16, and FIGS. 17 and 18, each depict an alternative embodiment of a compression release apparatus positioned on a rotatable cam shaft 5, according to the present invention. The compression release apparatus is operable with an internal combustion engine having one or more combustion chambers (not shown). As is typical in the art, each chamber is equipped with a reciprocable piston, at least one intake valve, at least one exhaust valve, and at least one valve operating device including a valve tappet, in communication with the intake or exhaust valve. In FIG. 1, the internal combustion engine further comprises a rotatable cam shaft 5 disposed in an engine housing (not shown) and having an outboard end 5*a* and an inboard end 5*b*. Mounted on the inboard end 5*b* of cam shaft 5 is a cam gear 9. Cam gear 9 is driven by a timing gear mounted on a crankshaft (not shown) for rotation therewith. The crankshaft is operably connected to each of the reciprocable pistons (not shown).

Cam lobes 6,7 are also mounted on cam shaft 5 and are rotatable therewith. Each cam lobe 6,7 has a cam 6*a*,7*a* respectively that typically engage a valve operating device to operate either the intake or the exhaust valves of the combustion chambers, as is required by the engine cycle.

To relieve pressure during the compression stroke in a combustion chamber during engine starting, the exhaust valve may be partially unseated during the piston compression stroke. In the compression release apparatus of the present invention, a lift member 13 engages a valve tappet 11 of a valve operating device (not shown) during part of the compression stroke, in lieu of cam lobe 6 (see FIG. 3). During this engagement, lift member 13 raises valve tappet 11 a sufficient linear distance to cause the exhaust valve to partially unseat, thereby relieving some pressure in the chamber. When the engine attains normal running speeds, lift member 13 no longer engages valve tappet 11 (see FIG. 4). At these speeds, there is sufficient centrifugal force acting on a centrifugally-responsive member, such as a flyweight 16, rotatable with cam shaft 5 to disengage lift member 13 from valve tappet 11.

FIGS. 1 through 7 depict a first embodiment of compression release apparatus 1 for relieving compression in a combustion chamber during engine starting. Lift member 13 moves valve tappet 11 to cause the valve operating device to partially unseat an exhaust valve associated with the combustion chamber. FIGS. 8 through 16 depict a second embodiment, wherein a compression release apparatus 201 relieves compression in two separate combustion chambers during engine starting. The compression release apparatus 1,201 in both embodiments includes a centrifugally-responsive flyweight 16,216 and a base member 19,219. Compression-release apparatus 1,201 of the present invention is lightweight yet sturdy, simple in design and requires few parts. Moreover, compression release apparatus 1,201 is easy to assemble and does not require major modification to the engine components.

FIG. 1 is a perspective view of a first embodiment of the present invention wherein compression release apparatus 1 is positioned substantially adjacent cam shaft 5. Cam shaft 5 has an outboard end 5*a* and an inboard end 5*b*. Compression release apparatus 1 includes a lift member 13 positioned on an outboard side of cam gear 9, substantially adjacent cam lobe 6, and substantially outside of cam shaft 5. Cam lobe 6 is engageable with valve tappet 11 of a valve operating device to operate an exhaust valve during engine operation.

Figure 3:
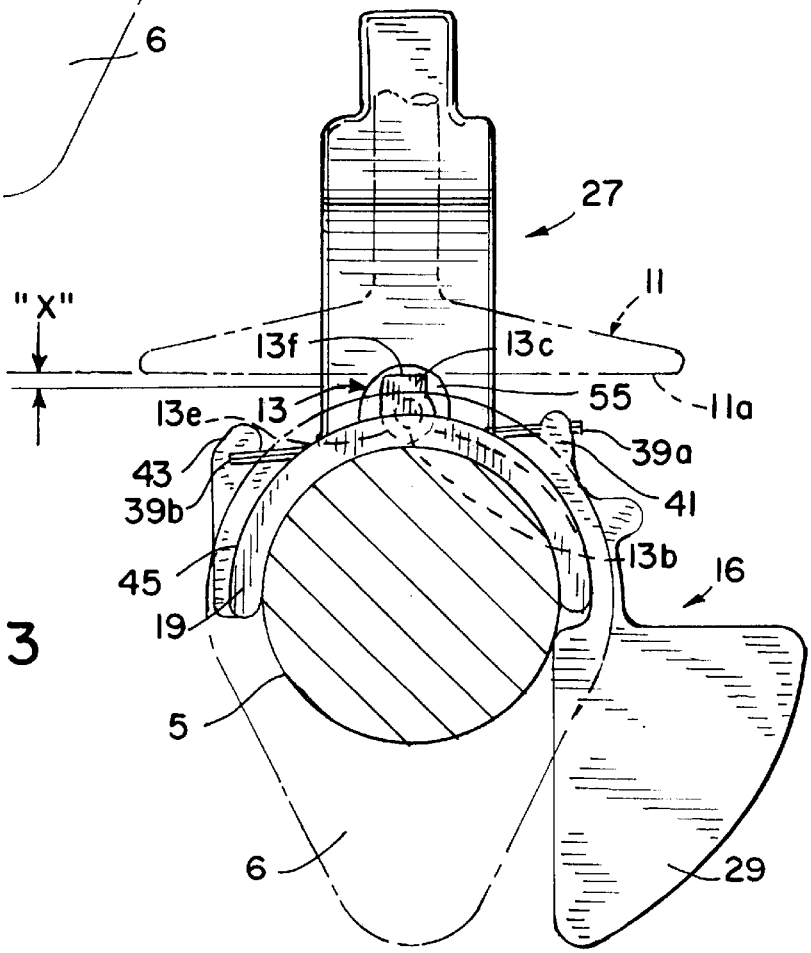
FIG. 3 is a cross-sectional end view of the compression release apparatus, taken along line 3—3 of FIG. 2 with the flyweight in the rest position.

As best shown in FIGS. 3 and 4, lift member 13 preferably has a substantially eccentric shape and is rotatable about an axis parallel to cam shaft 5. Lift member 13 has a disk-shaped body comprising two distinct sections—a narrow section 13*b* defined by a generally uniform radius and a broad section 13*c* defined by a greater non-uniform radius. Narrow section 13*b* has a substantially rounded outer surface 13*e* of uniform radius. Broad section 13*c* has a generally flat outer surface 13*f* defined by an abrupt increase in radii. Broad section 13*c* is engageable with a bottom surface 11*a* of valve tappet 11 of a valve operating device.

The valve operating device operates an exhaust valve for one of the combustion chambers of the engine. As depicted in FIG. 4, when lift member 13 is oriented such that narrow section 13*b* faces or engages valve tappet 11, narrow section 13*b* is flush with the top of cam lobe 6 and valve tappet 11 is in a lowered position (relative to cam shaft 5) during the compression stroke. When broad section 13*c* engages valve tappet 11 during the compression stroke, valve tappet 11 is moved to its raised position (relative to cam shaft 5) due to the greater radial dimension of broad section 13*c* (see FIG. 3).

When valve tappet 11 is in the raised position, it maintains the exhaust valve in a partially unseated condition. As will be explained in greater detail below, valve tappet 11 is moved to its raised position whenever a centrifugally-responsive flyweight 16 is at an orientation corresponding to engine starting speeds or when the engine is at rest. When valve tappet 11 is moved to the lowered position, the valve operating device causes the exhaust valve to seat during the compression stroke. Valve tappet 11 is moved to its lowered position during the compression stroke when centrifugally-responsive flyweight 16 is at an orientation corresponding to normal engine running speeds.

In alternative embodiments of the invention, the lift member has a variety of shapes. In each embodiment, the lift member has a surface or point engageable with bottom surface 11*a* of valve tappet 11 to move valve tappet 11 to its raised position. In one embodiment, the lift member is rotatable and substantially D-shape, or only the outboard end is D-shaped. In another embodiment, the lift member has a cone-shaped tip portion. The cone tip is disposed in parallel with cam shaft 5 and pointed towards cam lobe 6. The lift member of this embodiment is not rotatable but is linearly movable in a direction parallel to bottom surface 11*a* of valve tappet 11. To raise valve tappet 11, the lift member is gradually moved in an outboard direction towards cam lobe 6. As the cone surface engages bottom surface 11*a*, the lift member displaces valve tappet 11, thereby moving valve tappet 11 in a direction outward from cam shaft 5. To lower valve tappet 11, the lift member is simply retracted from bottom surface 11*a* until disengaged therefrom.

Further embodiments of the invention may utilize a lift member which is both rotatable and linearly movable, or a lift member having different shapes which achieve essentially the same result but at different lifting rates. Moreover, the lift member may be positioned partially below a surface of the cam shaft for all or part of engine operation. In these applications, the cam shaft may be modified with a recess, groove, or other surface irregularity for accommodating the lift member and lift member movement.

Figure 6:
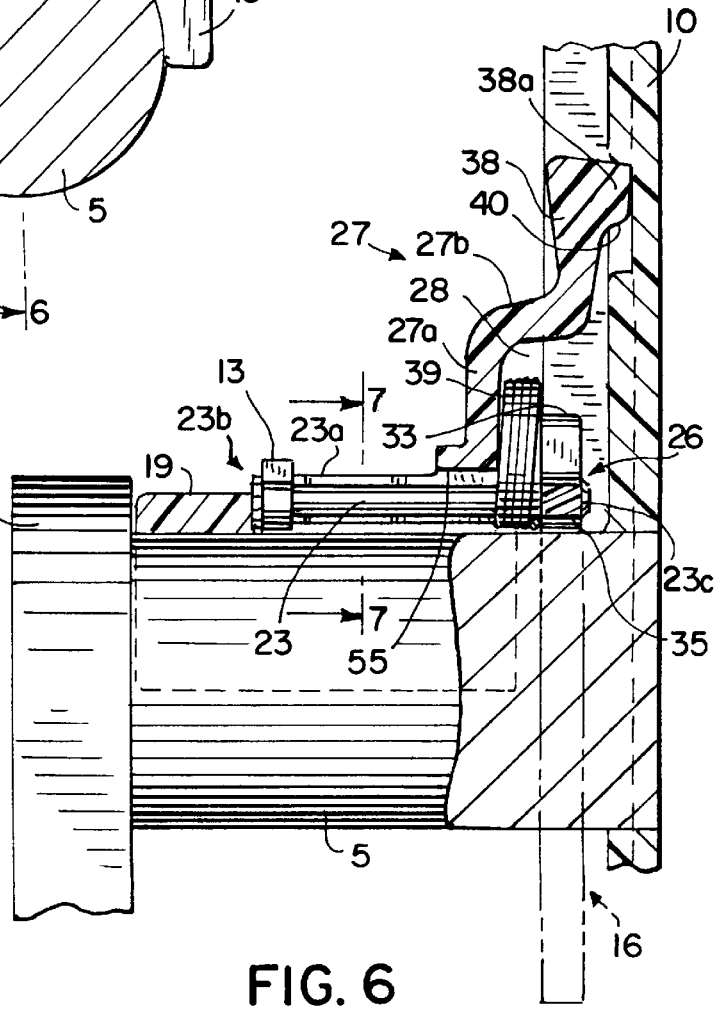
FIG. 6 is a cross-sectional side view of the compression release apparatus, taken along line 6—6 of FIG. 5.

Referring to FIG. 6, flyweight 16 is interconnected to lift member 13 such that movement of flyweight 16 in response to engine speeds causes lift member 13 to change the position of valve tappet 11. Lift member 13 is interconnected with flyweight 16 via rotatable lift pin 23, and through a lift pin-lift member connection 23*b* and a lift pin-flyweight connection 26. Lift pin 23 is disposed lengthwise along cam shaft 5 and is substantially perpendicular to lift member 13. The outboard-end 23*a* of lift pin 23 is connected to lift member 13 at lift pin-lift member connection 23*b*, such that the two are pivotally cooperable and rotatable about a common axis.

Figure 5:
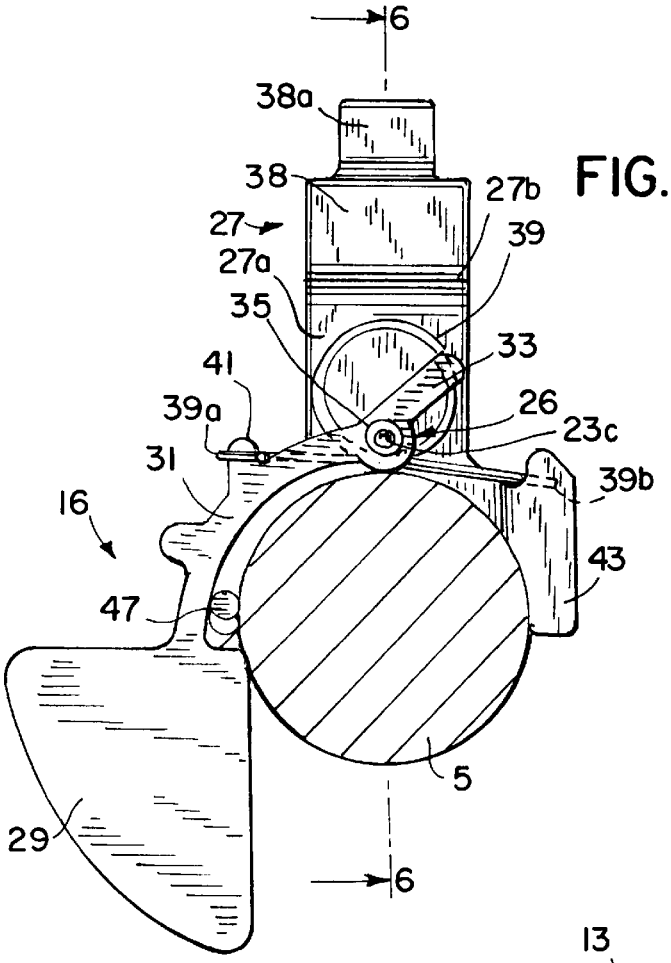
FIG. 5 is a cross-sectional end view of the compression release apparatus, taken along line 5—5 of FIG. 2.
Figure 7:
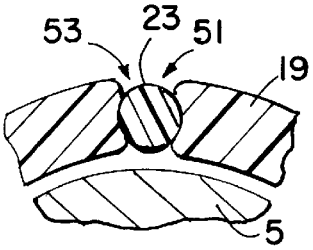
FIG. 7 is cross-sectional end view of the base member and lift pin, taken along line 7—7 of FIG. 6.

Referring to FIG. 5, lift pin connection 26 interconnects an inboard end 23*c* of lift pin 23 to flyweight 16, thereby effectively transmitting the energy of centrifugally-responsive flyweight 16 to lift pin 23 and to lift member 13. This centrifugal force creates a moment about lift pin connection 26, thereby rotating lift pin 23 and lift member 13.

In an alternative embodiment, the lift pin is not rotatable but linearly movable along cam shaft 5. In this embodiment, compression release apparatus 1 provides alternative interconnecting means to convert torsion exerted by the flyweight into linear force acting on the lift pin. This function may be performed by an archimedes screw, a gear system or an equivalent. The underlying concept in this embodiment, and in further embodiments, is to transmit energy embodied by a radially-moving flyweight into movement of valve tappet 11 by a lift member. Intermediate transmission elements such as the lift pin, the lift member, and other components may be moved linearly, rotationally or both.

The positioning of lift member 13 on cam shaft 5, in alternative embodiments, is determined by the location of cam lobe 6 and valve tappet 11. Accordingly, the length of the lift pin is partly governed by the distance between flyweight 16 and cam lobe 6. In further embodiments, however, the flyweight may be positioned outward on cam shaft 5 and closer to cam lobe 6. In that case, the lift pin and the base member take on smaller dimensions.

As depicted in FIGS. 1 through 6, compression release apparatus 1 may also be equipped with an arm member 27 to provide greater stability. Arm member 27 of the first embodiment extends from the top of base member 19 to abut a shoulder 10 on cam gear 9. When flyweight 16 is positioned closer to lift member 13 or the length of base member 19 is shortened, the arm member may be extended further to accommodate the modification and to ensure stability in compression release apparatus 1 during operation.

In yet another embodiment of the present invention, compression release apparatus 1 may be made without a lift pin, in which case, the flyweight and the lift member are directly connected. Thus, the flyweight directly transmits rotational energy to the lift member. In one specific embodiment, a rod or other projection is affixed to the flyweight for insertion into a cooperable sleeve affixed to the lift member. In a further embodiment, the lift member and the flyweight are made from one piece, rather than being two distinct parts as in apparatus 1.

Flyweight 16 of the embodiment depicted in FIGS. 1 through 7, is comprised of at least two distinct portions—a flat, head portion or flyweight head 29, and an elongated, crescent-shaped moment arm 31 coaxial with lift pin 23. Flyweight 16 of the first embodiment may also have a third distinct portion—a spring retainer arm 33—which will be described later. As best depicted in FIGS. 5 and 6, flyweight 16 lies in a plane that is generally normal to the axis of lift pin 23 and pivotally receives lift pin 23 in an aperture 35 located on an axial end of moment arm 31. Moment arm 31 and lift pin 23 are connected at lift pin connection 26 such that flyweight 16 is rotatable about the axis of lift pin 23. Most of the flyweight mass is concentrated in flyweight head 29 away from lift pin connection 26. Since flyweight 16 moves radially with the rotation of cam shaft 5, the configuration of moment arm 31 and the mass of flyweight head 29 partly governs at which engine speed flyweight 16 is radially extended and the magnitude of the centrifugal force acting on flyweight head 29.

FIG. 3 depicts the positions of the components of compression-release apparatus 1 when the engine is at rest or is at starting speeds. Flyweight 16 is disposed in a rest position nearly adjacent to cam shaft 5. At this position, the shape of crescent-shaped moment arm 31 substantially articulates the cylindrical shape of cam shaft 5. Broad section 13*b* of lift member 13 has been moved radially outward and will engage bottom surface 11*a* of valve tappet 11 during the compression stroke, as depicted in FIG. 3. Valve tappet 11 has been moved to a distance away from cam lobe 6, as denoted by dimension "X". The valve operating device, at this position of valve tappet 11 during the compression stroke, has unseated the exhaust valve to relieve some pressure in the combustion chamber.

In FIG. 4, the engine is at running speeds and flyweight 16 has been moved radially outward, away from cam shaft 5, by centrifugal force. The centrifugal force acting on flyweight head 29 creates sufficient torsion about the axis of lift pin 23 to have rotated lift pin 23 and lift member 13, and to radially extend flyweight 16. Broad section 13*c* of lift member 13 no longer engages bottom surface 11*a*. Therefore, valve tappet 11 is not raised or lowered relative to cam shaft 5 during the compression stroke. Accordingly, the exhaust valve is seated during the compression stroke.

Compression release apparatus 1 of the present invention may also include means for returning radially extended flyweight 16 to a rest position. In the first embodiment shown in FIGS. 1 through 7, the returning function is provided by a torsion spring 39. Additionally, spring 39 helps maintain flyweight 16 at or near its rest position during starting of the engine. As best shown in FIGS. 5 and 6, spring 39 encircles lift pin 23, on the outboard side of flyweight 16 and adjacent moment arm 31. In this embodiment, spring 39 is held in place through engagement with spring retainer arm 33, flyweight 16 and base member 19. A bent first end 39*a* of spring 39 is wrapped around a projection 41 on the outer surface of moment arm 31, thereby engaging flyweight 16. A bent second end 39*b* is secured to a projection 43 on base member 19. Furthermore, spring retainer arm 33 is provided with a flange portion (not shown) upon which several windings of spring 39 rest.

As illustrated in FIGS. 4 and 5, spring 39 is biased against flyweight 16 to oppose radial movement of flyweight 16 from its rest position to its radially outward position. The compressive spring force helps prevent flyweight 16 from moving radially during starting. At starting speeds, the product of the velocity of the flyweight head 29 (a function of the overall radial length of flyweight 16 at any given time, and rotational speed) and the mass of flyweight head 29 is insufficient to overcome the resistant spring force and relevant frictional forces. At running speeds, flyweight 16 velocity is high enough for the resultant centrifugal force to overcome the resistant forces and to cause flyweight 16 to extend radially outward.

In alternative embodiments, the flyweight may be sized and configured such that gravitational force alone is sufficient to return the flyweight to its rest position and to prevent the flyweight from radially extending at starting speeds. In further alternative embodiments, counterweights may be provided in lieu of, or to assist, the spring and/or gravitational forces to perform the returning function.

Base member 19 of compression release apparatus 1, as depicted in FIGS. 1 through 7, is positioned substantially adjacent cam shaft 5. Base member 19 may be of a plastic material and injection molded to a desired shape. Preferably, the shape of base member 19 corresponds to the shape of the outer surface of cam shaft 5 and allows base member 19 to be easily snapped onto cam shaft 5 during assembly. In the embodiment depicted in FIGS. 1 through 7, base member 19 is injection molded to a shape of a segmented cylinder, and thus, snugly fits onto cylindrical cam shaft 5. The segmented-cylindrical shape is approximated by providing base member 19 with curved lower sections 45 which fit over a substantial portion of the outer surface of cam shaft 5, as depicted in FIG. 2.

In the first embodiment, compression release apparatus 1 also has an arm member 27 interconnected with base member 19. Arm member 27 extends from the top of base member 19 and abuts shoulder 10 on cam gear 9, as shown in FIG. 6. Thus, arm member 27 helps retain base member 19 in its position adjacent cam shaft 5, while adding support and stability to apparatus 1. Arm member 27 is also designed such that the compression release apparatus 1 can still be snapped onto cam shaft 5 during engine assembly. Furthermore, arm member 27 is preferably injection molded and is of a non-metallic material which does not add significant weight to apparatus 1. In the first embodiment of FIGS. 1 through 7, only lift pin 23, lift member 13, and flyweight 16 are made from a non-plastic material. Of course, the base member may also be made from a metal, and may be stamped or rolled.

In the first embodiment as depicted in FIGS. 1 and 6, arm member 27 has a lower portion 27*a* which is substantially transverse to base member 19 and extends therefrom. An intermediate bridge portion 27*b* is curved away from lower portion 27*a* towards cam gear 9. Intermediate bridge portion 27*b* is then connected to boot 38 which is positioned adjacent to a shoulder 10 on cam gear 9. Shoulder 10 forms a channel 40 and boot 38 has a heel portion 38*a* that engages channel 40, thereby providing additional stability to apparatus 1.

The dimensions of lower portion 27*a* and bridge portion 27*b* are partly determined by the positioning of base member 19 relative to cam gear 9 and also by the design and selection of centrifugally responsive flyweight 16. In the embodiment shown, lower portion 27*a* is high enough and bridge portion 27*b* is long enough to define a lower space 28 which provides clearance for the range of motion of flyweight 16 (see FIG. 6).

Further modifications to base member 19 or arm member 27 may be made to provide additional stability and support, and to more readily allow compression release apparatus 1 to be snap-fit to cam shaft 5 and/or cam gear 9. These modifications may include extension of various retaining parts of the base member or the arm member, and providing additional projections which engage components of the cam shaft 5 or cam gear 9. In an alternative embodiment, the base member may be provided with a projection, spring, or pin which engages part of cam lobe 6. Moreover, variations in the shape of the base member in combination with variations in the shape of the arm member may be combined to obtain a desired fit.

In addition to allowing the compression release apparatus 1 to be snap-fit to cam shaft 5 and to cam gear 9, base member 19 also functions as a frame and housing for various dynamic components of the apparatus 1. For example, spring 39 has a second end 39*b* which is bent to wrap around a projection 43 on base member 19 (See FIG. 2). Base member 19 also provides a flyweight stop 47—a finger-like projection extending from lower curve section 45 of base member 19 (See FIG. 1). Before apparatus 1 is snap-fit to cam shaft 5, flyweight stop 47 supports flyweight 16 and holds flyweight 16 out of the way so as to facilitate installation of apparatus 1 on cam shaft 5. Once apparatus 1 is snap-fit to cam shaft 5, flyweight 16 may then rest on cam shaft 5 at low engine speeds or when the engine is at rest (see FIG. 5).

In the first embodiment as depicted in FIGS. 1 through 7, wherein a rotatable lift pin 23 is included, base member 19 also provides for unimpeded rotation of lift pin 23 and lift member 13. In the top view of FIG. 2, lift pin 23 and lift member 13 are shown disposed along cam shaft 5 and adjacent base member 19. Base member 19 provides a roller pocket 49 in which lift member 13 rotates. For lift pin 23, base member 19 also functions as a guide and support means. First, base member 19 provides a channel 51 with a groove 53 therein, which guides the rotation of lift pin 23. Channel 51 and groove 53 also support part of the weight of lift pin 23 and bending loads exerted by the weight of lift member 13. As shown in FIGS. 3 and 6, base member 19 has an opening 55 in lower portion 27*a* of arm member 27 to accommodate extension of lift pin 23 from groove 53 to lift pin connection 26.

FIGS. 8 through 16 depict a second embodiment of the invention. In the second embodiment of the present invention, compression release apparatus 201 employs centrifugally responsive flyweight 216 interacting with a first and a second lift member 213,214 to operate more than one valve of an internal combustion engine. First lift member 213 is connected to an outboard end 223*a* of a first lift pin 223, at lift pin-lift member connection 223*b*. A second lift member 214 is connected to an outboard end 224*a* of a second lift pin 224, at lift pin-lift member connection 224*b*. Apparatus 201 also includes means 225 for interconnecting each of first or second lift pins 223,224 with flyweight 216 (see FIG. 13). Base member 219 of the second embodiment is similar to base member 19 of the first embodiment, but has been modified to accommodate second lift member 214, second lift pin 224 and interconnecting means 225. Because apparatus 201 employs a single flyweight 216, duplication of parts and complexity is avoided. Consistent with general design objectives, base member 219 is also lightweight, allows compression release apparatus 201 to be snapped onto a position adjacent cam shaft 5 during assembly, and does not require major modification to the engine.

FIG. 8 is a perspective view of the second embodiment of the present invention, wherein the compression release apparatus 201 employs a first and second lift member 213,214, a first and second lift pin 223,224, and single flyweight 216. First lift member 213 is engageable with a first valve tappet 11 of a first valve operating device positioned directly above cam lobe 6. Second lift member 214 is engageable with a second valve tappet 12 of a second valve operating device (not shown) positioned directly above cam lobe 7. In the embodiment shown, first and second valve operating devices are associated with a first and second exhaust valve for a first and second combustion chamber (not shown), respectively, of a V-twin engine. However, it is within the ordinary skill of someone skilled in the art to adapt the compression release apparatus of the present embodiment, in which the apparatus operates a plurality of valves, to cooperate with an internal combustion engine of a different design.

In the embodiment depicted in FIGS. 8 through 16, lift members 213,214 are positioned entirely outside of cam shaft 5. In alternative embodiments, lift members 213,214 may be partially disposed in a recess, groove or other area beneath the outer surface of cam shaft 5. Furthermore, lift members 213,214 may be partially disposed in such a recess, groove, or other area beneath the outer surface of cam shaft 5 for only a particular stage in the operation of the compression release apparatus.

Lift members 213,214 of the second embodiment are of substantially the same design and have substantially the same function as lift member 13 of the first embodiment, except that lift member 214 is somewhat longer than lift member 13. When the engine is at starting speeds, lift members 213,214 maintain first and second valve tappets 11,12 in their raised positions during the compression stroke. At normal running speeds, broad sections 213*c*,214*c* of lift members 213,214 do not significantly engage bottom surfaces 11*a*,12*a* of valve tappets 11,12 during the compression stroke. However, the timing of engagement of lift members 213,214 with valve tappets 11,12 may be varied as required by engine operation. Thus, lift members 213,214 do not necessarily have to cause the valve operating devices to seat or unseat their respective exhaust valves (or intake valves) at the same time.

FIGS. 8 and 9 depict lift pins 223,224 and lift members 213,214 disposed along cam shaft 5. Base member 219 provides a roller pocket 249 in which first lift member 213 rotates. Base member 219 also incorporates means for supporting first lift pin 223 and guiding lift pin 223 rotation. Just inboard of lift member 213, base member 219 defines a channel 251 and a groove 253 contained therein. Channel 251 supports the load on lift pin 223, namely the bending load created by lift member 213. Channel 251 and groove 253 also guide rotation of lift pin 223. Further inboard on cam shaft 5, base member 219 provides a semi-cylindrical pin tunnel or housing 257 which is coaxial with groove 253 and wherein a substantial portion of lift pin 223 freely rotates. Lift pin 223 then extends past pin housing 257 and is interconnected with flyweight 216.

Because second lift member 214 is positioned outboard of first lift member 213, second lift pin 224 is longer and experiences potentially greater bending loads than first lift pin 223. Thus, compression release apparatus 201 provides a more elaborate guide and support means for second lift pin 224 and second lift member 214. Generally, the guide and support means are comprised of rotational guides and intermediate support elements. In the present embodiment, apparatus 201 includes a groove 261 in an opposite surface 6*b* of cam lobe 6 (see FIGS. 9 and 15). Groove 261 guides rotation of second lift pin 224 and supports part of the load exerted on second lift pin 224. Inboard of groove 261, base member 219 defines a second channel 263 having two walls 264 which are disposed lengthwise along cam shaft 5 and extend over the top of second lift pin 224 (see FIGS. 8 and 9). Inside walls 265 of channel 263 are formed to partially correspond to the shape of second lift pin 224, thereby defining a groove 267 coaxial with groove 261. Adjacent the inboard end 264*a* of channel walls 264, an intermediate roller guide 269 is fixedly mounted on second lift pin 224 such that roller guide 269 rotates with second lift pin 224 (see also. FIG. 14). Base member 219 also defines a gap or roller pocket 271 between inboard end 264*a* of channel walls 264 and a second pin tunnel 273. Roller pocket 271 is sized to allow for rotation of intermediate roller guide 269 and to cushion against any tendency for axial movement of second lift pin 224. Finally, second pin tunnel 273 is equivalent in form and function to first pin tunnel 257.

Thus, base member 219 of the present invention is completely adaptable to a multi-lift, member-lift pin arrangement for compression-release apparatus 201. Besides maintaining the position of compression release apparatus 201 on cam shaft 5, base member 219 also acts as a frame, a housing and a guide for various components of the compression release apparatus 201. As illustrated in FIGS. 8 through 16, base member 219 successfully incorporates all of the components of the compression release apparatus 201 into one very sturdy, very compact and operable unit. Moreover, apparatus 201 is lightweight, easy to assemble and does not require major modification to the engine. Note that installing groove 261 on opposite surface 6*b* of cam lobe 6 requires only a simple drill operation which has little impact on engine assembly. In fact, groove 261 facilitates installation of the two lift pin-lift member compression release apparatus 201 and permits apparatus 201 to be snapped onto cam shaft 5 and cam gear 9 at the same time.

Figure 10:
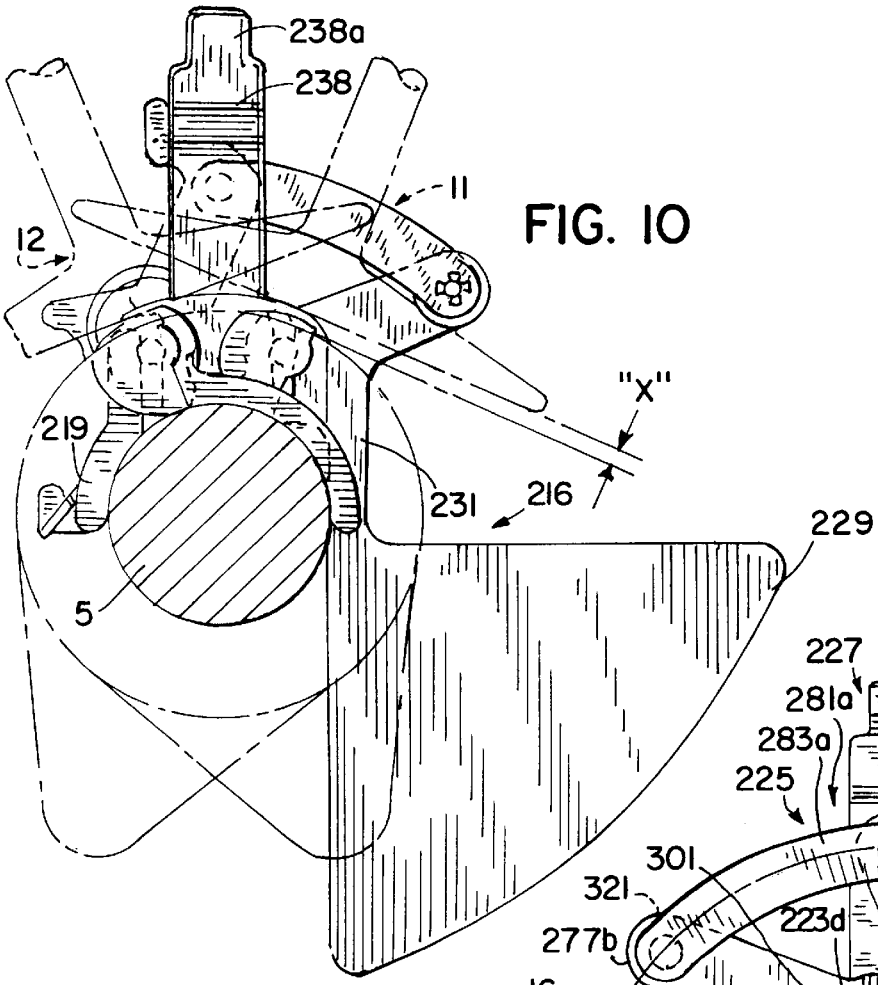
FIG. 10 is an end view of the second embodiment of the present invention taken along line 10—10 of FIG. 9, depicting the compression release apparatus with the flyweight and the lift members in their rest positions when the engine is at rest or at engine starting speeds.
Figure 11:
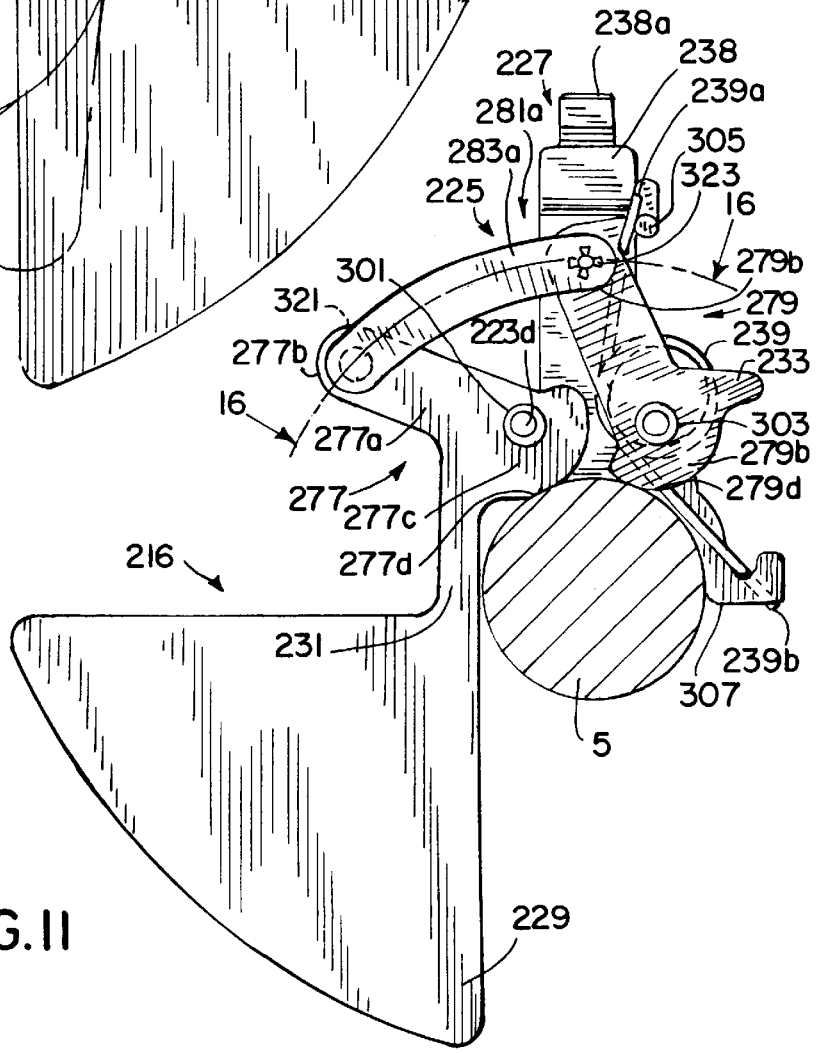
FIG. 11 is an opposite end view of the second embodiment of the present invention depicting the flyweight and interconnecting means in their rest positions, when the engine is at rest or at normal engine starting speeds.

The second embodiment of compression release apparatus 201 (FIGS. 8 through 16) also employs a single torsion spring 239 for returning flyweight 216 to its rest position upon sufficient reduction in engine speeds (FIGS. 10 and 11). Spring 239 also helps maintain flyweight 216 at its rest position during starting of the engine. In FIGS. 11 and 13, first and second ends 239*a*,239*b* of spring 239 are attached to a portion 305 of a connecting arm 279, spring retainer arm 233, and a portion 307 of base member 219, respectively. Furthermore, spring retainer arm 233 shoulders several windings of spring 239. In alternative embodiments, the retainer arm may be incorporated into the base member, the flyweight moment arm, or either of one of the connecting arms as described below), whichever is convenient. In further embodiments of the present invention, a plurality of torsion springs may be provided, i.e., a torsion spring for each lift pin 223,224.

Figure 12:
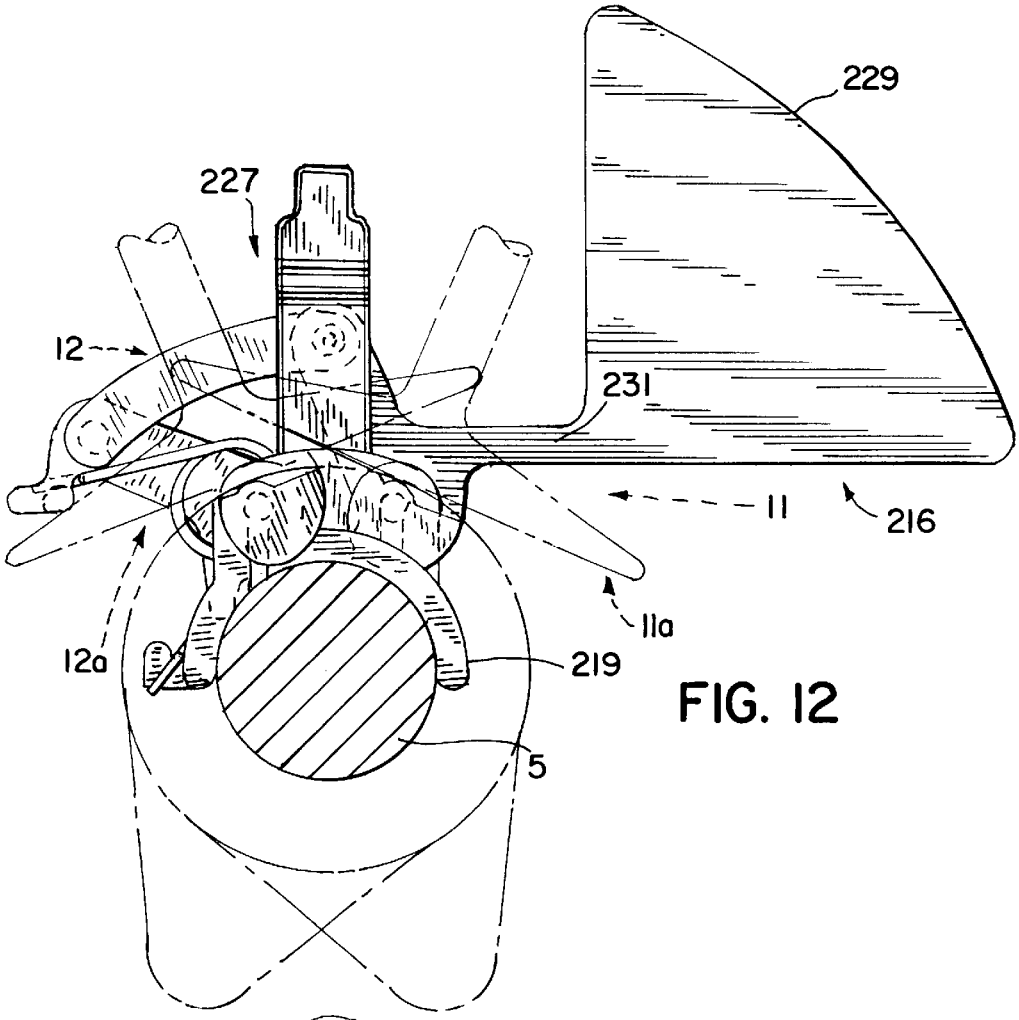
FIG. 12 is an end view of the second embodiment of the present invention, depicting the compression release apparatus, when the engine is at normal running speed.
Figure 13:
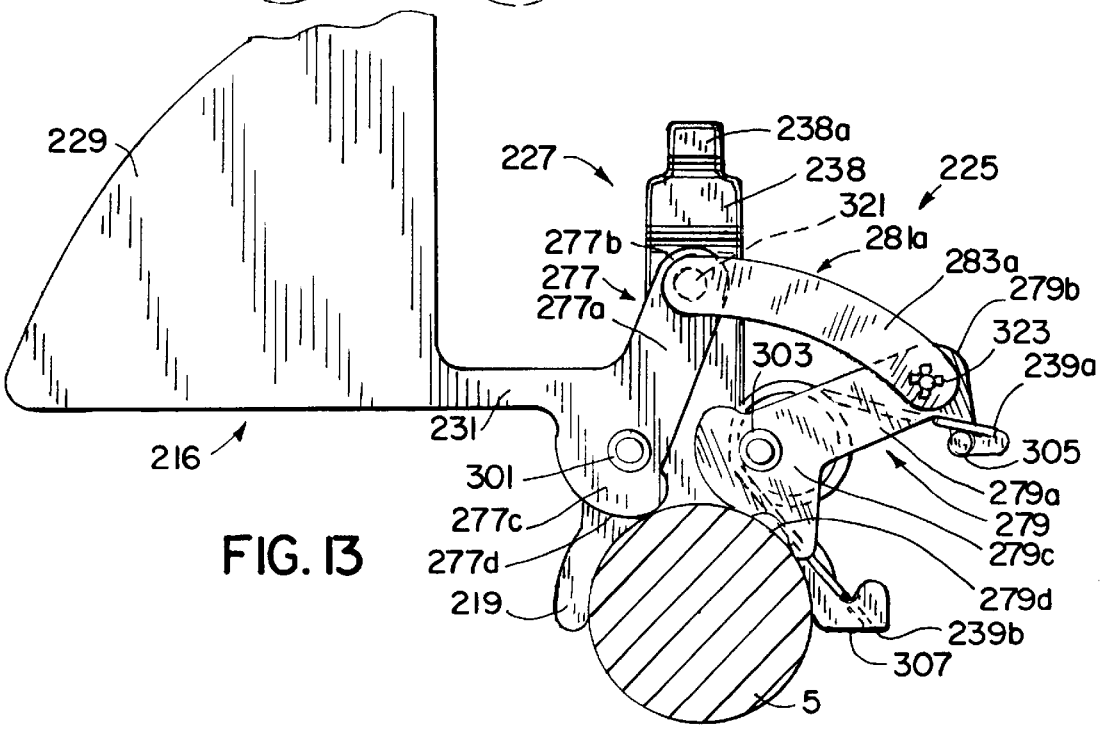
FIG. 13 is an opposite end view of the second embodiment of the present invention, depicting the flyweight and interconnecting means in their positions when the engine is at normal running speed.

FIGS. 10 through 13 depict the ranges of motion for the components of the compression release apparatus 201 and for valve tappets 11,12 of a V-twin internal combustion engine. FIGS. 10 and 11 are front and rear end views, respectively, of the compression release apparatus 201 with flyweight 216 in the rest position and with valve tappets 11,12 in their raised positions. FIGS. 12 and 13 are front and rear end views, respectively, of compression release apparatus 201 with flyweight 216 in the radially-extended position and with valve tappets 11,12 disengaged from lift members 213,214. The end views of FIGS. 11 and 13 give particular emphasis on means 225 for interconnecting lift members 213,214 or lift pins 223,224 with flyweight 216. In FIGS. 11 and 13, interconnecting means 225 is comprised of a primary connecting arm 277 connected to flyweight 216 and to an inboard end 223*c* of first lift pin 223, a secondary connecting arm 279 connected to an inboard end 224*c* of second lift pin 224, and a double linkage arrangement 281 connecting primary and secondary connecting arms 277, 279.

As previously described, flyweight 216 comprises a flyweight head 229 and a moment arm 231. In the second embodiment, moment arm 231 connects to primary connecting arm 277 which is connected to first lift pin 223. Primary connecting arm 277 comprises a slender body 277*a* having a fixed end 277*c* adjacent cam shaft 5 and a movable lever end 277*b* outward from cam shaft 5.

As best shown in FIG. 11, primary connecting arm 277 and flyweight 216 are formed together from one piece, wherein moment arm 231 extends from an intermediate section of the connecting arm body 277*a*. In alternative embodiments, flyweight moment arm 231 may be pin-connected to a separate primary connecting arm 277. A separate primary connecting arm 277 may be desirable for maintenance purposes, or alternatively, for manufacturing purposes. Furthermore, it may be desirable for primary and secondary connecting arms 277,279 to be identical and interchangeable so that manufacturing, assembly and maintenance are simplified.

In the embodiment of FIGS. 8 through 16, primary connecting arm 277 is connected at fixed end 277*c* to inboard end 223*c* of first lift pin 223, at pin connection 301. Thus, primary connecting arm 277 is pivotable about the axis of first lift pin 223. Accordingly, rotation of flyweight 216 results in primary connecting arm 277 driving the rotation of first lift pin 223. Furthermore, rotation of first lift pin 223 drives rotation of first lift member 213 thereby changing the position of first valve tappet 11. Linear movement of valve tappet 11, as has been explained, causes the exhaust valve to seat or partially unseat in a predetermined manner. Thus, the interaction of flyweight 216 with a first lift member 213 in the second embodiment is substantially the same as that in the previously described first embodiment.

In the second embodiment of the compression release apparatus 201, second lift pin 224 is connected to secondary connecting arm 279, at pin connection 203. Thus, second lift pin 224 is responsive to movement of second connecting arm 279. Secondary connecting arm 279 comprises a slender body 279*a* having a fixed end 279*c* adjacent cam shaft 5, and a movable lever end 279*b* radially outward from cam shaft 5. Secondary connecting arm 279 receives inboard end of second lift pin 224 at pin connection 303 near fixed end 279*c*. Thus, secondary connecting arm 279 and second lift pin 224 are rotatable about the axis of second lift pin 224.

Both fixed ends 277*c*,279*c* of primary and secondary connecting arms 277,279 define a substantially rounded outer surface 277*d*,279*d* in partial engagement with the outer surface of cam shaft 5. When primary and secondary connecting arms 277,279 are rotated, rounded surfaces 277*d*,279*d* move over the outer surface of cam shaft 5. In alternative embodiments, base member 219 may be extended towards cam gear 9 so that fixed ends 277*c*,279*c* of primary and secondary connecting arms 277,279 engage the plastic outer surface of base member 219 rather than the metallic outer surface of cam shaft 5.

As shown in FIG. 16, primary and secondary connecting arms 277,279 are interconnected by a pair of parallel links—an inboard link 281*a* and an outboard link 281*b*. Links 281*a*, 281*b* are spaced apart to define a gap, wherein lever ends 277*b*,279*b* of primary and secondary connecting arms 277, 279 are partially received. Each of links 281*a*,281*b* comprises a slender, arched body 283*a*,283*b* having a curved longitudinal axis defined by a slight concavity, and a first end 289*a*,289*b* and a second end 291*a*,291*b*.

Links 281*a*,281*b* connect primary and secondary connecting arms 277,279 at pivotable connections 321,323. As depicted in FIGS. 11 and 16, each of links 281*a*,281*b* is equipped with an aperture (not shown) positioned on the longitudinal axis at both first end 289*a*,289*b* and second end 291*a*,291*b* and aligned with matching apertures on the opposing link 281*a*,281*b* and apertures (not shown) on lever ends 277*b*,279*b* of primary and secondary connecting arms 277,279. Referring to FIG. 16, link 281*a* also has a sleeve 309 affixed to its first end 289*a* to which collet fingers 313 are attached. Collet fingers 313 are received in an aperture 289*c* in link 281*b*, thereby connecting first ends 289*a*,289*b* of link 281*a* and link 281*b*. Similarly, link 281*b* has a sleeve 311 affixed to its second end 291*b* to which collet fingers 315 are attached. Collet fingers 315 are received in an aperture 291*c*, thereby connecting second ends 291*a*,291*b* of link 281*a* and link 281*b*. As best illustrated in FIG. 16, sleeves 309,311 are insertable into the apertures on lever ends 277*b*,279*b* such that primary and secondary connecting arms 277,279 are pivotable about sleeves 309,311, respectively.

Therefore, links 281*a*,281*b* are connectible to, and movable by, primary connecting arm and secondary arm 277,279 at pivotable connections 321, 323, respectively. Moreover, first end 289*a*,289*b* of links 281*a*,281*b* and primary connecting arm 277 are co-pivotable about pivotable connection 321, and second end 291*a*,291*b* of links 281*a*,281*b* and secondary arm 279 are co-pivotable about pivotable connection 323. During rotation of flyweight 216 about first lift pin 223, primary and secondary connecting arms 277,279 direct links 281*a*,281*b* along a rotational path as partly determined by the longitudinal axis of links 281*a*,281*b*. In alternative embodiments, each of collet fingers 313,315 may be replaced with a pin connection, nut and bolt connection, or the like.

FIGS. 11 and 13 depict the two extreme angular positions of flyweight 216, primary and secondary connecting arms 277,279, and links 281*a*,281*b*. As flyweight 216 is radially extended, flyweight moment arm 231 applies a force on an intermediate point of primary connecting arm 277 so as to rotate flyweight 216 and primary connecting arm 277 about pin connection 301. Rotation of primary connecting arm 277 causes lever end 277*b* to apply a force at pin connection 321. A force normal to a transverse axis of links 281*a*,281*b* is applied at pin connection 321, thereby causing links 281*a*, 281*b* to move. Lever end 277*b* of primary connecting arm 277 and first end 289*a*,289*b* of links 281*a*,281*b* also pivot about pin connection 321 to accommodate the movement of links 281*a*,281*b* through a rotational path.

Accordingly, links 281*a*,281*b* apply a force at second pin connection 323. This force has a component normal to the longitudinal axis of secondary connecting arm 279 which creates a moment on secondary connecting arm 279 about pin connection 303. As a result, secondary connecting arm 279 is caused to rotate and to drive lift pin 224 as well. Thus, second lift member 214 is also rotated. Second lift member 214 does not engage valve tappet 12 so that the exhaust valve is seated and unseated only by engagement between cam lobe 7 and valve tappet 12 in a manner determined by normal engine operation.

Also note the positioning of spring 239 in the embodiment as shown in FIGS. 11 and 13. Spring 239 has a first end 239*a* that engages a projection 305 on lever end 279*b* of secondary connecting arm 279, and a second end 239*b* that engages a flange 307 on base member 219. Spring 239 also encircles second lift pin 224, outboard of flyweight 216. Thus, spring 239 is biased such that the compressive spring force is applied against the rotation of secondary connecting arm 279. Specifically, the compressive force resists rotation of secondary connecting arm 279 from its rest position as shown in FIG. 11 to its position as shown in FIG. 13 during normal engine speeds. When engine speeds are sufficiently reduced, the compressive force returns secondary connecting arm 279 from its position as shown in FIG. 13, back to its rest position, as shown in FIG. 11.

More generally, the compressive spring force acts to return flyweight 216 from its radially extended position, as shown in FIG. 13, to its rest position as shown in FIG. 11, when there is sufficient reduction in engine speeds. Additionally, compressive spring force also acts against centrifugal force on flyweight head 229 to maintain flyweight 216 in its rest position during starting speeds. Transmission of compressive spring forces to flyweight 216 is achieved through interconnecting means 275 in a manner which is essentially the reverse of the mechanics previously described.

In alternative embodiments, means 275 for interconnecting flyweight 216 to first and second lift pins 223,224 and transmitting centrifugal force from flyweight head 229 to lift members 213,214 may be achieved in a variety of ways. More specifically, different connecting arm linkage arrangements may be employed. In a variation of the embodiment shown in FIGS. 8 through 16, the primary connecting arm and the secondary connecting arm are directly connected by pin or the like. In yet another variation, the compression release apparatus is disposed on cam shaft 5 so as to eliminate one or both lift pins 223,224 and to directly connect flyweight 216 to first lift member 213 and/or second lift member 214. Flyweight 216 may also be disposed on cam shaft 5 between a pair lift members, a lift pin and a lift member, or a pair of lift pins.

In further embodiments, the configuration of the moment arm, the primary connecting arm, the pair of links, or the secondary connecting arm, as well as the design of the spring may be varied to obtain different responses to engine speeds. In one embodiment, the flyweight is directly connected to the first and second lift pins. In such an embodiment, the moment arm is configured so as to allow attachment to the inboard ends of both lift pins. In yet another embodiment, the flyweight is directly connected only to the first lift pin but not to the second lift pin. Instead, the second lift pin is interconnected with the second lift member and the flyweight through a belt assembly or cam member disposed on cam shaft 5 or on the first lift pin.

In further embodiments of the present invention, a centrifugally-responsive flyweight transfers motion to one or more lift pins or lift members through engagement of two or more gears. In these embodiments, a driving gear is integrated into an axial end of the flyweight. When the flyweight moves in response to engine speeds, the driving gear drives one or more secondary gears disposed between one or more lift members and the flyweight. In one embodiment, the driving gear is a wheel type gear that shares a common axis of rotation with the rest of the flyweight. In an alternative embodiment, the driving gear is a rack gear which changes the linear motion of the flyweight into rotation of one or more secondary gears. In both embodiments, the secondary gear is interconnected with a lift member such that rotation of the secondary gear results in movement of the lift member. When a lift pin is used, the secondary gear is mounted onto an inboard end of the lift pin such that rotation of the gear translates to rotation of the lift pin.

In one embodiment including two lift members, a driving gear drives two secondary gears simultaneously. In another embodiment, a driving gear drives a secondary gear that is interconnected with a first lift member, and the secondary gear drives a follower gear that is interconnected with a second lift member. In yet another embodiment, the driving gear is mounted onto an inboard end of a first lift pin and interconnected with a first lift member, but also drives a secondary gear that is interconnected with a second lift member.

Figure 18:
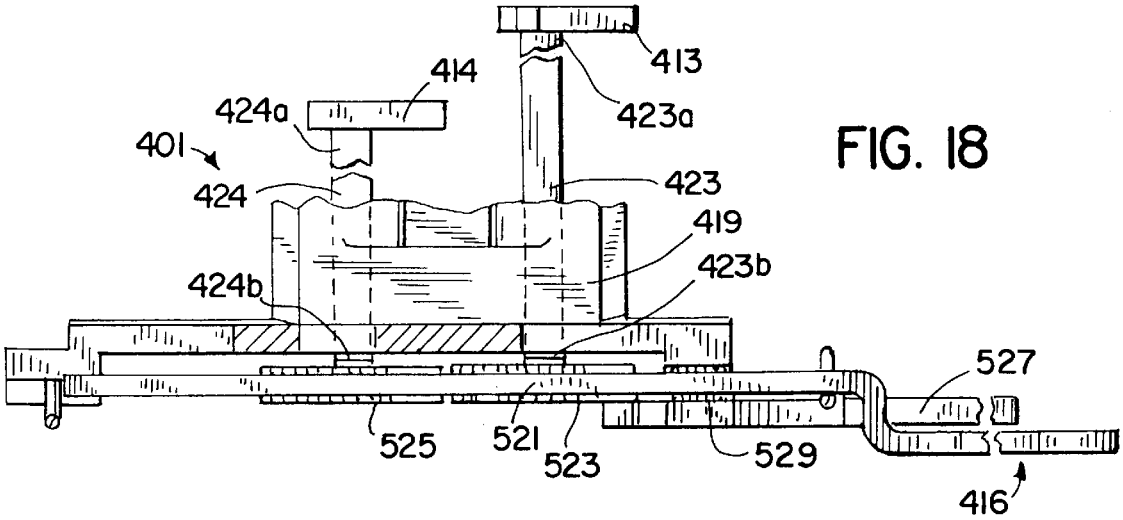
FIG. 18 is a top view of the third embodiment of the invention depicted in FIG. 17, with a portion of the base member cut away to better depict the lift members.
Figure 17:
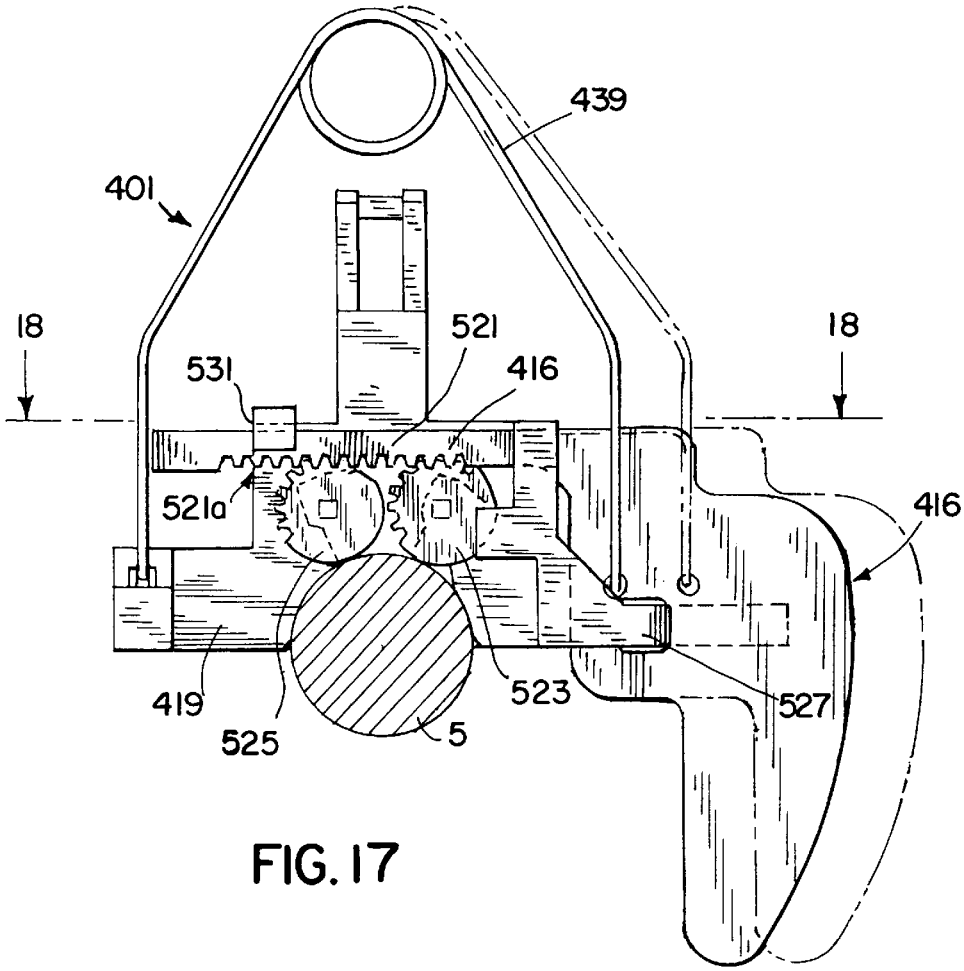
FIG. 17 is an end view of the third embodiment of the invention depicting the flyweight, the rack member and two gears, when the engine is at rest or at normal engine starting speeds.

FIGS. 17 and 18 depict a third embodiment of a compression-release apparatus 401 of the present invention. Apparatus 401 includes a rack gear 521 that is integral with a centrifugally-responsive flyweight 416 at an axial end 416*a*. Rack gear 521 is equipped with a row of teeth 521*a* that engages a pair of secondary gears 523,525 simultaneously (the three gears 521,523,525 are hereinafter referred to as rack 521, first gear 523, and second gear 525). Referring now to the end view of FIG. 17, apparatus 401 includes a base member 419 mounted onto cam shaft 5 and a spring 439 fixed to both base member 419 and flyweight 416. FIG. 17 depicts, in solid lines, the positions of flyweight 416 and spring 439 when the engine is at rest or at starting speeds. FIG. 17 also depicts, in dash lines, the positions of flyweight 416 and spring 439 when the engine is at normal running speeds.

FIG. 18 is a top view of apparatus 401, with a portion of base member 419 cut away so that a first lift member 413 and a second lift member 414 are better illustrated. FIG. 18 depicts first lift member 413 being connected to a first lift pin 423 at an outboard end 423*a*, and second lift member 414 being connected to a second lift pin 424, also at an outboard end 424*a*. First gear 523 is mounted onto an inboard end 423*b* of first lift pin 423 and second gear 525 is mounted onto an inboard end 424*b* of second lift pin 424.

When the engine approaches normal running speeds, flyweight 416 of the present embodiment is moved radially outward along a slide bar 527, and rack 521 is moved along a rail 529 and a guide 531. Each of slide bar 527, rail 529, and guide 531 is formed integral with base member 419.

Referring to the end view of FIG. 17, when rack 521 moves outward with flyweight 416, first and second gears 523,525 are driven in a clockwise direction by rack 521. Accordingly, first gear 523 causes first lift pin 423 and first lift member 413 to rotate in the clockwise direction. As well, second gear 525 also causes second lift pin 424 and second lift member 414 to rotate in the clockwise direction.

While several embodiments of the present invention has been shown and described, alternate embodiments will be apparent to those skilled in the art and are within the intended scope of the present invention. Therefore, the scope of the present invention is to be limited only by the following claims.

We claim:

1. A compression release apparatus that relieves compression in first and second combustion chambers of an internal combustion engine, said engine having a rotatable cam shaft, a first valve operating device associated with said first chamber and a second valve operating device associated with said second chamber, said compression release apparatus comprising:

a base member having a shape that substantially corresponds to an outer surface of said cam shaft;

a first lift member engageable with said first valve operating device;

a second lift member engageable with said second valve operating device; and a centrifugally-responsive device that changes the position of said first and second lift members in response to engine speed.

2. The compression release apparatus of claim 1, wherein said centrifugally-responsive device includes a single flyweight.

3. The compression release apparatus of claim 1, further comprising:

apparatus that interconnects said centrifugally-responsive device with said first and second lift members.

4. The compression-release apparatus of claim 3, wherein said centrifugally-responsive device includes a single flyweight, and wherein said interconnection apparatus includes a link member interconnected between said flyweight and said second lift member.

5. The compression release apparatus of claim 1, further comprising:

a first lift pin interconnected between said first lift member and said centrifugally-responsive device; and a second lift pin interconnected between said second lift member and said centrifugally-responsive device.

6. The compression release apparatus of claim 5, wherein said base member includes:

a first guide for said first lift pin, said first guide having a shape partially corresponding to the shape of said first lift pin; and a second guide for said second lift pin, said second guide having a shape partially corresponding to the shape of said second lift pin.

7. A compression release apparatus that relieves compression in first and second combustion chambers of an engine, said engine having a rotatable cam shaft and first and a second valve operating devices associated with said first and second chambers respectively, said apparatus comprising:

a first lift member engageable with said first valve operating device;

a second lift member engageable with said second valve operating device;

a centrifugally-responsive device that changes the positions of said first and second lift members in response to engine speed, said centrifugally-responsive device including a single flyweight;

a first lift pin interconnected between said first lift member and said centrifugally-responsive device; and a second lift pin interconnected between said second lift member and said centrifugally-responsive device;

wherein at least one of said first and second lift pins is positioned substantially outside of said cam shaft.

8. The compression release apparatus of claim 7, further comprising:

a return device that returns said flyweight to a rest position.

9. The compression release apparatus of claim 8, wherein said return device includes a torsion spring.

10. The compression release apparatus of claim 7, further comprising:

apparatus that interconnects said first and second lift members with said centrifugally-responsive device.

11. The compression release apparatus of claim 10, wherein said interconnection apparatus includes:

a connection between said flyweight and said first lift member; and a link member interconnected between said flyweight and said second lift member.

12. The compression release apparatus of claim 7, further comprising:

a base member having a shape that corresponds to an outer surface of said cam shaft, said base member including a retainer that retains said base member in a position adjacent to said cam shaft.

13. The compression release apparatus of claim 7, wherein said engine includes a cam gear having a shoulder, said apparatus further comprising:

a base member; and an arm interconnected with said base member, said arm abutting said shoulder on said cam gear.

14. The compression release apparatus of claim 7, further, comprising:

at least one gear member that is responsive to movement of said flyweight, wherein at least one of said first and second lift members is responsive to movement of said at least one gear member.

15. The compression release apparatus of claim 14, further comprising:

a rack member, interconnected with said flyweight, that engages said gear member.

16. A compression release apparatus that relieves compression in first and second combustion chambers of an engine, said engine having a rotatable cam shaft and first and second valve operating devices associated with said first and second chambers respectively, comprising:

a first lift pin;

a first lift member interconnected with said first lift pin, said first lift member engageable with said first valve operating device and responsive to a change in position of said first lift pin;

a second lift pin;

a second lift member interconnected with said second lift pin, said second lift member engageable with said second valve operating device and responsive to a change in position of said second lift pin; and a centrifugally-responsive device that changes the positions of said first and second lift pins in response to engine speed, said centrifugally-responsive device having a single flyweight.

17. The compression release apparatus of claim 16, further comprising:

a return device that returns said flyweight to a rest position.

18. The compression release apparatus of claim 17, wherein said return device includes a torsion spring.

19. The compression release apparatus of claim 18, further comprising:

a connection between said flyweight and at least one of said first and second lift pins.

20. The compression release apparatus of claim 19, wherein said connection includes a connecting arm that connects said flyweight to at least one of said first and second lift pins, said connecting arm being responsive to radial movement of said flyweight, wherein at least one of said first and second lift pins is responsive to movement of said connecting arm.

21. The compression release apparatus of claim 16, further comprising:

a connection between said flyweight and said first and second lift pins, including a primary connecting arm that interconnects said flyweight with said first lift pin, said primary connecting arm being responsive to radial movement of said flyweight, said first lift pin being responsive to movement of said primary connecting arm; and a secondary connecting arm that interconnects said flyweight with said second lift pin, said secondary connecting arm being responsive to radial movement of said flyweight, said second lift pin being responsive to movement of said secondary connecting arm.

22. The compression release apparatus of claim 21, wherein said connection further includes at least one link member interconnected between said flyweight and said secondary connecting arm.

23. The compression release apparatus of claim 21, wherein said connection further includes at least one link member interconnected between said secondary connecting arm and said primary connecting arm.

24. The compression release apparatus of claim 21, wherein said primary and secondary connecting arms are rotatable with radial movement of said flyweight, and wherein said first and second lift pins are rotatable with the rotation of said primary and secondary connecting arms respectively.

25. The compression release apparatus of claim 21, further comprising:

a return device that returns said flyweight to a rest position, including at least one torsion spring engageable with at least one of said primary and secondary connecting arms.

26. The compression release apparatus of claim 16, further comprising:

a base member having a shape that at least partially corresponds to an outer surface of said cam shaft; and a retainer that retains said base member in a position adjacent to said cam shaft.

27. The compression release apparatus of claim 16, said engine including a cam gear, further comprising:

a base member; and an arm interconnected with said base member and abutting a surface on said cam gear.

28. The compression release apparatus of claim 16, further comprising:

at least one gear member that is responsive to movement of said flyweight, wherein at least one of said first and second lift pins is responsive to movement of said at least one gear member.

29. The compression release apparatus of claim 16, further comprising:

a rack member, interconnected with said flyweight, that engages said gear member.

* * * * *